United States Patent [19]

Klaus et al.

[11] 4,365,431

[45] Dec. 28, 1982

[54] COPY HOLDER

[75] Inventors: Gerald R. Klaus, St. Charles; Thomas E. Williams, Schaumburg; Paul D. Nizzere, Darien, all of Ill.

[73] Assignee: Bankers Box Company, Itasca, Ill.

[21] Appl. No.: 205,343

[22] Filed: Nov. 10, 1980

[51] Int. Cl.[3] ..... B41J 11/64

[52] U.S. Cl. ..... 40/352; 40/152.1

[58] Field of Search ..... 40/352, 152.1, 100, 40/120; 281/15 B

[56] References Cited

U.S. PATENT DOCUMENTS

| | | | |
|---|---|---|---|
| 479,129 | 7/1892 | Wirths | 40/152.1 |
| 953,456 | 3/1910 | Bowman | 40/344 |
| 1,381,757 | 6/1921 | Sheean | 40/352 |
| 1,631,807 | 6/1927 | Gillette | 40/158 |
| 1,892,492 | 12/1932 | Molner | 40/152.1 |
| 2,029,091 | 1/1936 | Bern | 40/152.1 |
| 2,234,086 | 3/1941 | Rosebraugh | 40/16 X |
| 2,480,918 | 9/1949 | Goldman | 40/152.1 |
| 2,677,910 | 5/1954 | Morgan | 40/621 |
| 2,746,191 | 5/1956 | Goldman | 40/152.1 |
| 2,833,070 | 5/1958 | Goldman | 40/152.1 |
| 3,086,658 | 4/1963 | Palmer | 211/50 |
| 3,153,400 | 10/1964 | Mendels | 40/352 |
| 3,298,124 | 1/1967 | Jahn | 40/158 R |
| 3,350,045 | 10/1967 | Mayers | 248/205 |
| 3,616,558 | 11/1971 | Jahn | 40/152.1 |
| 3,965,594 | 6/1976 | Candor | 248/530 |
| 4,058,283 | 11/1977 | Frechtman | 248/441 |
| 4,098,009 | 7/1978 | Flynn | 248/441 |
| 4,242,817 | 1/1981 | Ballard | 40/152.1 |

OTHER PUBLICATIONS

Brochure from Edanbob Corp., Franklin Park, Illinois, pp. 3, 4.

Brochure from Globe-Weiss of Wauseon, Ohio, entire description of copy stands.

Brochure on Oxford Copyholders: entire description of copyholders.

Brochure from Wilson Jones Co. of Chicago, Illinois (AD6665), pp. 2, 3, 4.

*Primary Examiner*—Paul J. Hirsch

*Assistant Examiner*—Wenceslao J. Contreras

*Attorney, Agent, or Firm*—Hume, Clement, Brinks, Willian & Olds, Ltd.

[57] ABSTRACT

A copy holder which simultaneously positions and supports a first relatively loose display and a second relatively fixed display in a manner so that the displays does not interfere with each other. A rigid support member defines a flat display panel, a pair of side flanges and a lower supporting ledge. Leg means supports the panel in a selected upright position. A mounting means in the form of a transparent sheet is removably mounted to the support member so as to extend over the flat display panel. A first display can be loosely supported on the ledge in front of the transparent sheet. A second display can be more permanently positioned between the transparent sheet and the panel, so as to be visable through the transparent sheet. Magnet means can be provided to movably retain the loose first display in position against the front of the transparent sheet. A line guide also is preferably provided and movably mounted to the rigid support member in front of the transparent sheet.

7 Claims, 8 Drawing Figures

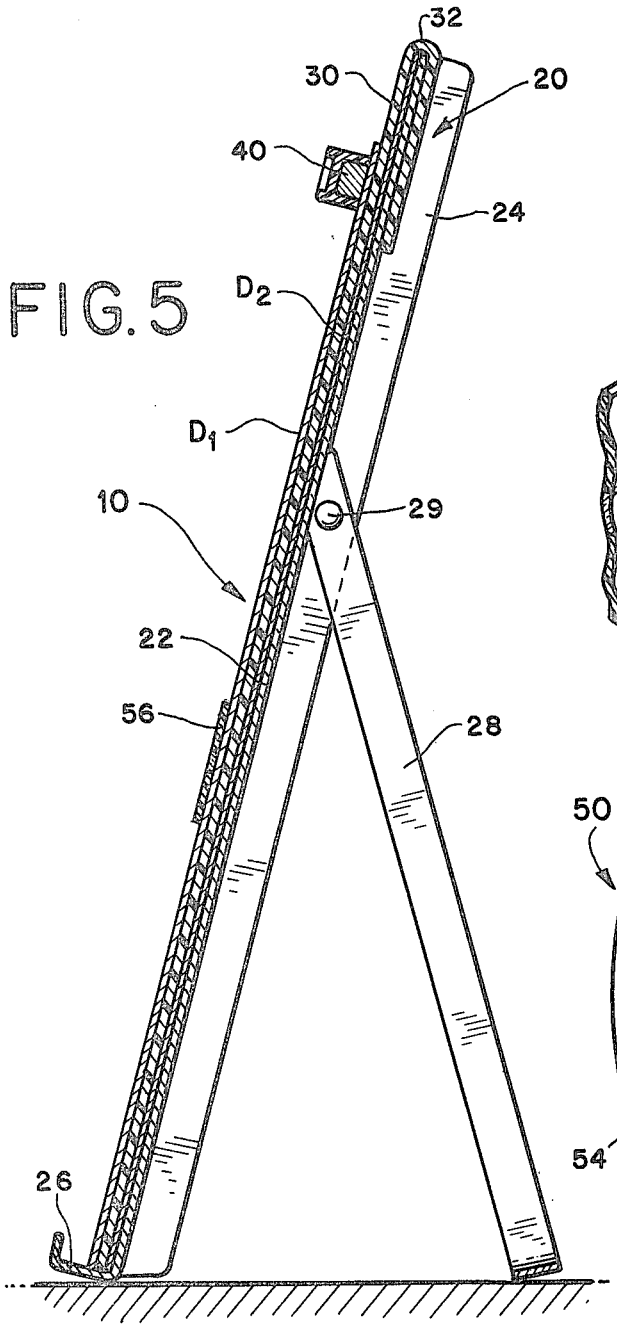
FIG. 5
FIG. 6
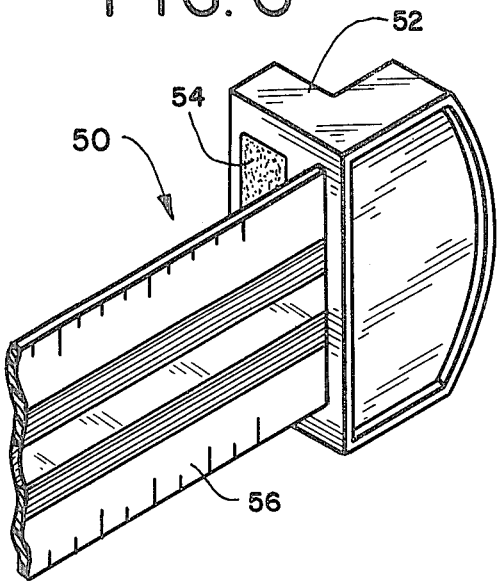
FIG. 7
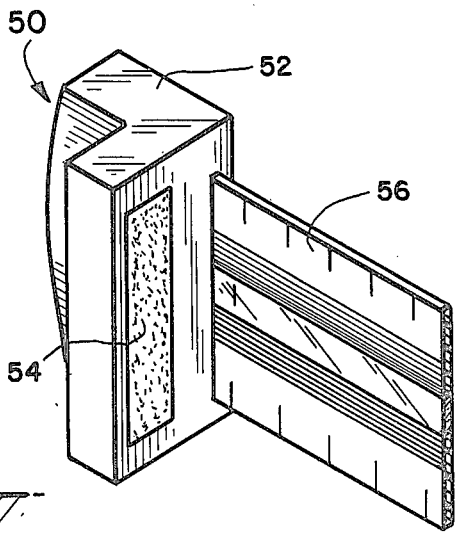
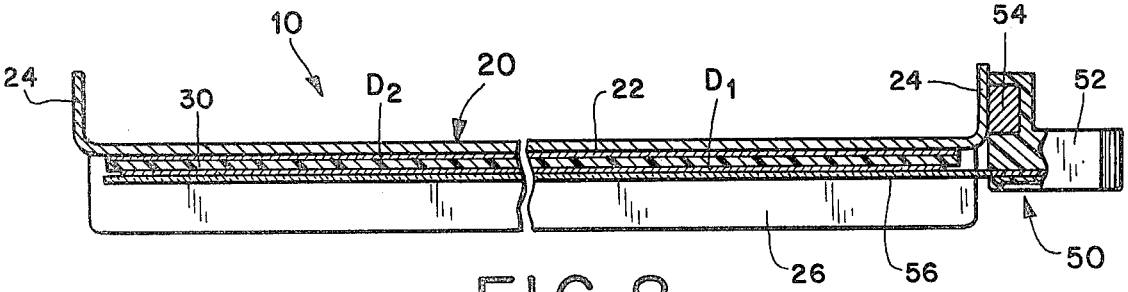
FIG. 8

COPY HOLDER

BACKGROUND OF THE INVENTION

This invention relates to a copy holder, and more particularly relates to a copy holder system which simultaneously performs the dual functions of positioning and supporting a temporary first display and a more permanent second display.

Portable copy holders have become standard equipment in offices. The copy holders are designed to support one or more sheets of material temporarily in an upright manner, so that the material can be readily viewed for purposes of typing, proofreading, or the like. A typical copy holder has an adjustable stand against which the material to be viewed rests. Various devices, such as magnets or clips, are used to retain the material on the copy stand.

Existing copy holder designs have met with varying degrees of success. Generally speaking, they satisfactorily support a sheet of material to be typed, copied or displayed for the purposes. However, their utility generally ends at that point. When the typical copy holder is not being used, it is either stored until needed again, or it is left standing on the desk, where it presents a relatively stark, unsightly and non-functional blank surface. Also, it is not unusual to find that the same office desk that holds a typical copy holder is cluttered with various other objects, such as phone listings, reference sheets, calendars, pictures or other decorative objects. The typical prior copy holder does not contribute to eliminating such an unsightly and inefficient condition.

To overcome the above deficiencies, the present invention provides a copy holder which simultaneously performs the dual functions of temporarily holding one or more sheets of material in a position for typing or viewing, while at the same time providing a system for mounting a more permanent second display in a manner which does not interfere with the first display.

To accomplish these dual functions, the copy holder in accordance with the present invention generally includes a rigid support member which defines a flat display panel. The support member includes a means for adjustably supporting the display panel in an upright position. A support ledge is provided along the bottom edge of the panel. Furthermore, transparent mounting means are provided and adapted to be removably connected to the support member above the front of the display panel. This mounting means supports a second display sheet in a relatively fixed position against the panel so that the sheet can be seen through the transparent mounting means. The first display sheet can be supported on the ledge so that it rests against the front of the transparent mounting means. Additional removable means can be provided to temporarily retain the first display sheet in the desired position.

ILLUSTRATIVE EMBODIMENT

Further objects and features of the present invention will become more apparent from a description of an illustrative embodiment thereof, taken in conjunction with the accompanying drawings, in which:

FIG. 5 is an enlarged sectional view of the copy holder taken along the line 5–5 in FIG. 2;

FIG. 6 is a partial perspective front view of a removable line guide which can be used with the copy holder in accordance with this invention;

FIG. 7 is a partial perspective rear view of the line guide shown in FIG. 6; and FIG. 8 is a sectional view of the copy holder taken along the line 8–8 in FIG. 2, showing the relationship between the support member, mounting means and the guide.

Figure 4:
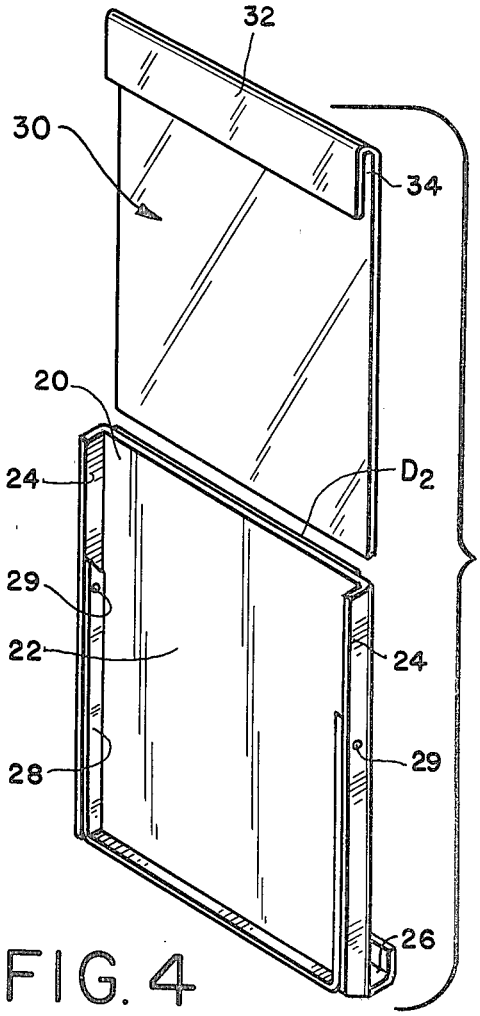
FIG. 4 is an exploded perspective view of the transparent mounting means and the rigid support member, illustrating the manner in which the mounting means can be frictionally secured to the support member.

Referring to the drawings in more detail, the copy holder in accordance with this invention is generally indicated by the reference numeral 10. The copy holder 10 ibcludes a rigid support member 20 which defines a flat front panel 22, flat side flanges 24, and lower support ledge 26. An adjustable U-shaped leg member 28 is pivoted to the side flanges 24 by pins 29. The leg 28 allows the copy holder to be positioned in a variety of upright positions on a support surface, such as a desk, to suit the needs of the user. As shown in FIG. 4, the leg 28 preferably is dimensioned to be foldable into the recess between the side edges 24, to facilitate storage and shipment of the copy holder 10. The support member 20 preferably is made from a metallic material, such as sheet steel, so that magnets can be used to retain copy materials on the front panel, as described further below.

The accordance with this invention, the copy holder 10 includes mounting means for cooperating with the rigid support member 20 to mount a display, $D_2$, in a relatively fixed position on the front panel 22 of the copy holder. This display is a second display, in addition to a relatively loose first display, $D_1$, that can be supported on the ledge 26. As shown with particularity in FIGS. 3 and 4, this mounting means comprises a transparent plastic sheet 30. The sheet 30 is formed from a plastic material having good clarity properties, and is preferably a clear acrylic material having a thickness of about 0.100 inches.

Figure 3:
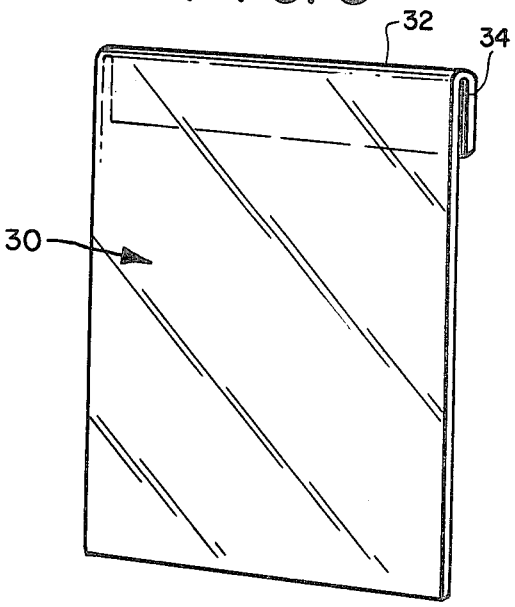
FIG. 3 is a perspective view of the transparent mounting means which can be removably secured to a support member for mounting the fixed display material on the copy holder.

The sheet 30 is adapted to be mounted on the support member 20 in a manner which covers the front panel 22. To accomplish this arrangement, as shown in FIGS 3–5, the upper portion of the sheet 30 is provided with a U-shaped bend 32 which defines a slot 34 dimensioned to frictionally engage with the upper edge of the panel 22 of the member 20. The width of the sheet 30 is selected so that the bend 32 will be captured between the side flanges 24, as shown in FIG. 4. Also, the length of the sheet 30 is selected to extend down to the ledge 26.

Figure 1:
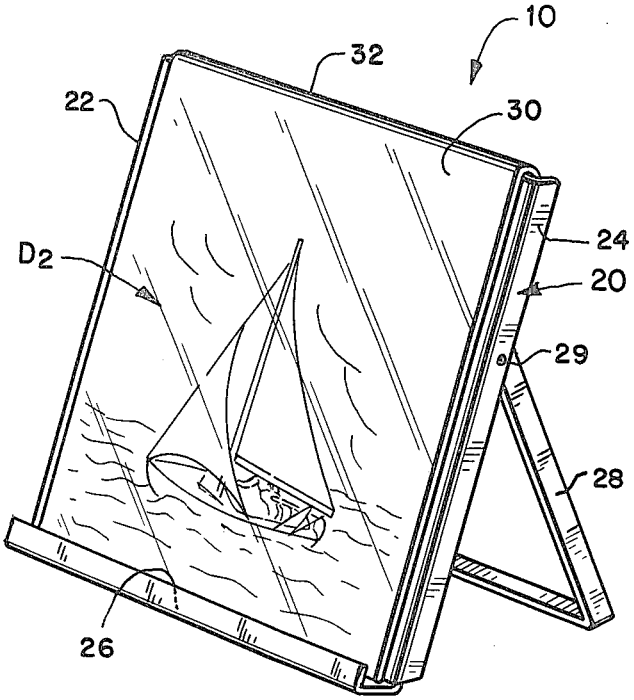
FIG. 1 is a perspective view of the copy holder in accordance with the present invention, illustrating the location and mounting of the relatively fixed display material on the copy holder.

The frictional fit between the support member 20 and the sheet 30 permits the insertion of a sheet of display material, $D_2$, as illustrated in FIGS. 1 and 5, between the rigid panel 22 and the transparent sheet 30. Thus, the copy holder 10 positions this relatively fixed display, $D_2$, behind the transparent sheet 30. The display $D_2$, which can be a picture, or a useful reference sheet such as a phone list, can be viewed easily through the sheet 30, without interfering with the use of the copy holder 10 to support the loose Display $D_1$. The Display $D_2$ also can be readily changed by sliding the sheet 30 upward and inserting another display beneath the sheet.

Figure 2:
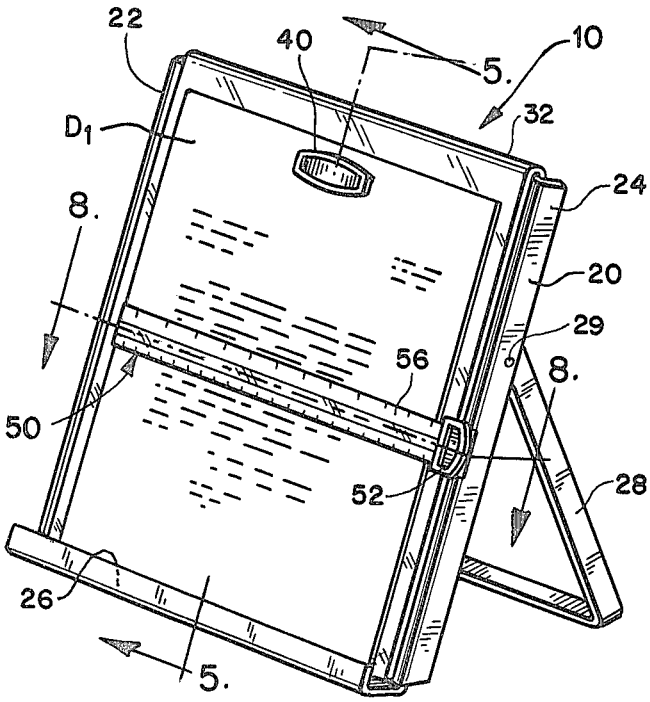
FIG. 2 is a perspective view of the copy holder illustrating the location and mounting of the temporary display material on the copy holder, in front of the fixed display material shown in FIG. 1.

As shown in FIGS. 2 and 5, the display $D_1$ usually comprises a loose document such as a sheet to be typed. The display $D_1$ can be placed on the ledge 26 and retained against the panel 22 by suitable means such as a magnet 40. It has been found that the thickness of the transparent sheet 30 within the above-stated range does not interfere with the flux of the magnet 40 and the resultant attraction of the magnet to the metallic panel 22.

Additionally, as shown in FIGS. 6–8, the copy holder 10 is adapted for use with a line guide 50. The guide 50 assists in retaining the loose display $D_1$ on the copy holder, and also functions as a line guide for highlighting the line on the document display $D_1$ to be read or typed. In the preferred arrangement, the line guide 50 includes a handle 52 with a magnet 54 which can movably engage either side flange 24 on the copy holder 10. The handle 52 supports a line guide ruler 56, which typically carries indicia such as pica and elite spacing markings. As shown clearly in FIG. 8, this arrangement allows the line guide 50 to magnetically clamp a side flange 24 with the ruler 56 extended over the front of the loose display material $D_1$.

In view of the foregoing, it will be apparent that the present invention provides a copy holder which will perform the dual functions of positioning and displaying two sets of display materials $D_1$ and $D_2$ in a manner so that the displays do not interfer with each other. The copy holder will thus improve the appearance and efficiency of office stations where it is used.

Although the invention has been described above with a certain degree of particularity, it should be understood that this disclosure has been made only by way of example. Consequently, numerous changes in the details of construction and in the combination and arrangement of the components, as well as in the possible modes of utilization in accordance with this invention will be apparent to those familiar with the art, and may be resorted to without departing from the scope of the invention.

What is claimed is :

1. A copy holder for positioning and supporting two displays simultaneously comprising:

a support member defining a flat front panel of selected height and width;

leg means to maintain said front panel in a generally upright position;

a first display positioned on said front panel of said support member;

transparent mounting means removably connectable to said support member and defining a transparent portion extending over said first display, said transparent mounting including an upper portion which has a U-shaped bend defining a slot dimensioned to frictionally engage an upper edge of said front panel;

ledge means positioned along a lower front portion of said support member;

a second display positioned and relatively loosely supported on said ledge means in front of said transparent mounting means; and means for supporting said second display against said transparent mounting means.

2. The copy holder of claim 1 wherein:

said support member includes side flanges; and said leg means is U-shaped and pivoted to said side flanges so that said leg means is adjustable to maintain said support member in a variety of upright positions said leg means dimensioned to fold into a recess between said side flanges.

3. The copy holder of claim 1 wherein said transparent mounting means comprises a sheet substantially co-extensive with said front panel.

4. The copy holder of claim 3 wherein said front panel is metallic and said means for supporting said second display removably retains said second display against said transparent sheet by magnetic attraction of said panel through said sheet.

5. The copy holder of claim 1 wherein said side flanges are metallic and further including a line guide extendable across said transparent mounting means and having magnetic means for movably securing said guide to said side flanges.

6. A copy holder for positioning and supporting two displays simultaneously comprising:

a support member defining a metallic front panel and metallic side flanges;

a U-shaped leg member pivotally connected to said metallic side flanges so that said U-shaped leg member is adjustable to maintain said support member in a variety of upright positions, said U-shaped leg member being dimensioned to fold into a recess between said metallic side flanges;

a first display positioned on said metallic front panel;

a transparent mounting sheet being removably positioned on said support member and defining a transparent portion extending over said first display, said transparent mounting sheet including an upper portion having a U-shaped bend defining a slot dimensioned to frictionally engage an upper edge of said metallic front panel;

a ledge positioned along a lower front portion of said support member, said ledge including a lip;

a second display positioned and supported on said ledge in front of said transparent mounting sheet; and at least one magnetic mounting member for retaining said second display against said transparent mounting sheet.

7. A copy holder for positoning and supporting two displays simultaneously comprising:

a support member defining a metallic front panel and metallic side flanges;

a U-shaped leg member pivotally connected to said metallic side flanges so that said U-shaped member is adjustable to maintain said support member in a variety of upright positions, said U-shaped leg member being dimensioned to fold into a recess between said metallic side flanges;

a transparent mounting sheet removably positioned on said support member in front of and substantially co-extensive with said front panel, said transparent mounting sheet including an upper portion having a U-shaped bend defining a slot dimensioned to slidably engage an upper edge of said metallic front panel, said transparent mounting sheet having a width approximately equal to that of the metallic front panel and being dimensioned so that a portion of said U-shaped bend is received within a recess between said metallic side flanges;

a ledge positioned along a front portion of said support member, said ledge including a lip;

a line guide extendable across the front of said transparent mounting member and having a magnetic member for movably securing said guide to said metallic side flanges; and said support member and said transparent mounting means cooperating so that a first display can be positioned between said transparent mounting means and said front panel and a second display can be simultaneously positioned in a relatively loosely supported position in front of said transparent mounting means adjacent said ledge.

* * * * *

UNITED STATES PATENT AND TRADEMARK OFFICE

CERTIFICATE OF CORRECTION

PATENT NO. : 4,365,431

DATED : December 28, 1982

INVENTOR(S) : Gerald R. Klaus, Thomas E. Williams, and Paul D. Nizzere

It is certified that error appears in the above-identified patent and that said Letters Patent are hereby corrected as shown below:

In the ABSTRACT, line 3, delete "does" and substitute therefor --do--;

Column 1, line 23, delete "the" and substitute therefor --other--;

Column 2, line 27, delete "ibcludes" and substitute therefor --includes--;

Column 3, line 33, delete "interfer" and substitute therefor --interfere--;

Column 3, line 58, after "mounting" add --means--;

Column 4, line 53, after "U-shaped" add --leg--.

Signed and Sealed this

*Twenty-third* Day of *August 1983*

[SEAL]

*Attest:*

GERALD J. MOSSINGHOFF

*Attesting Officer*

*Commissioner of Patents and Trademarks*